United States Patent [19]

Quillmann

[11] 4,010,821

[45] Mar. 8, 1977

[54] OMNIDIRECTIONAL SYMPATHETICALLY DRIVEN SOUND REPRODUCTION DEVICE

[76] Inventor: Leo-Heinz Quillmann, 4545 Laguna, No. 220, Boulder, Colo. 80303

[22] Filed: May 2, 1975

[21] Appl. No.: 574,166

[52] U.S. Cl. ..... 181/148

[51] Int. Cl.[2] ..... H04R 1/02; H04R 1/32

[58] Field of Search ..... 179/1 E, 181 R, 181 F; 181/163, 148, 167, 199

[56] References Cited

UNITED STATES PATENTS

| | | | |
|---|---|---|---|
| 1,856,749 | 5/1932 | Desbriere | 181/163 |
| 2,426,928 | 9/1947 | Gazlay | 181/199 |
| 2,476,572 | 7/1949 | Wenzel | 181/148 |
| 2,853,146 | 9/1958 | Coates | 181/148 |
| 3,164,221 | 1/1965 | Rich | 181/163 |
| 3,194,340 | 7/1965 | Kuwayama | 181/148 |
| 3,285,364 | 11/1966 | Cohen | 181/167 |
| 3,443,661 | 5/1969 | Vansciver | 181/199 |
| 3,596,733 | 8/1971 | Bertagni | 179/180 |
| 3,718,779 | 2/1973 | Schoengold | 179/181 F |
| 3,778,562 | 12/1973 | Wright | 179/111 R |

FOREIGN PATENTS OR APPLICATIONS

| | | | |
|---|---|---|---|
| 1,032,774 | 6/1966 | United Kingdom | 179/1 E |

*Primary Examiner*—George G. Stellar
*Attorney, Agent, or Firm*—O'Rourke, Harris & Hill

[57] ABSTRACT

A sound reproduction device formed of an enclosure of expanded or foamed polymeric material, preferably polystyrene, which houses a centrally suspended speaker system, preferably a wafer multi-range speaker system. The enclosure is substantially closed and is acoustically excited by the speaker system to propagate sound thus requiring only a small ventilation opening to permit movement of the enclosure walls.

7 Claims, 5 Drawing Figures

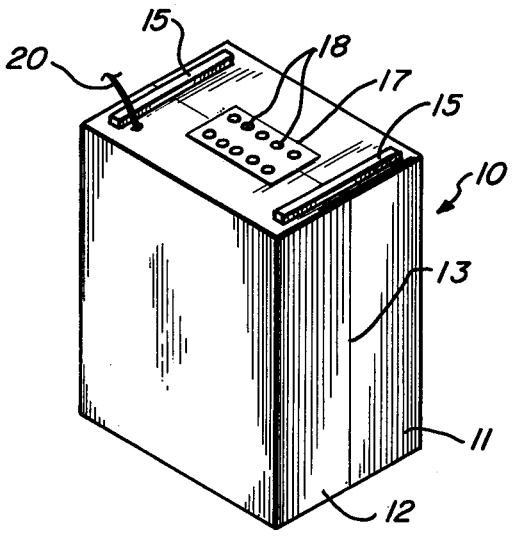
Fig_2
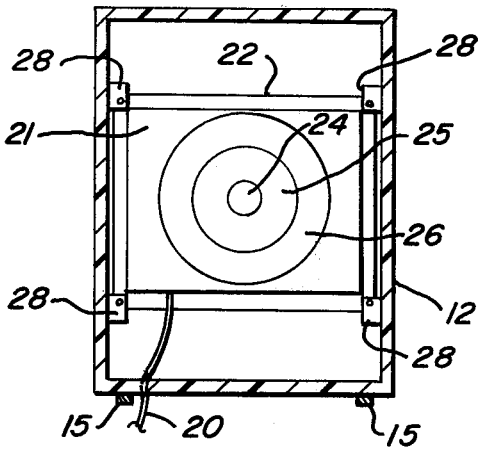
Fig_3
Fig_4
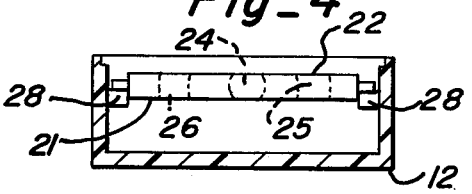
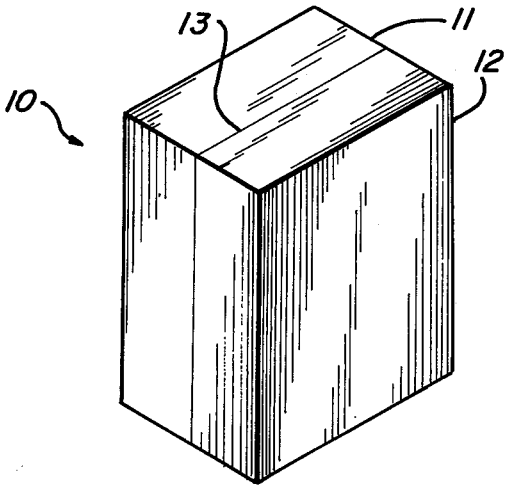
Fig_1
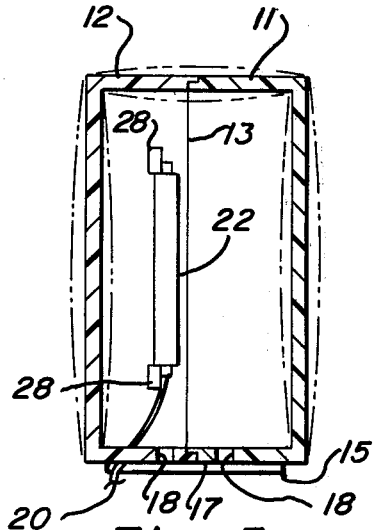
Fig_5

OMNIDIRECTIONAL SYMPATHETICALLY DRIVEN SOUND REPRODUCTION DEVICE

BACKGROUND OF THE INVENTION

1. Field of the Invention

The present invention relates generally to a sound reproduction device, and more particularly to a sound reproduction device in which the enclosure for the speaker system is driven by the speaker system and thus forms an integral part of the speaker reproduction system.

2. Description of the Prior Art

Classically, sound reproduction systems have employed electromagnetic means which drive a diaphragm. The cone or dome shaped diaphragm and electromagnetic driver are usually housed in an inflexible enclosure but, in general, embedded in isolating material to physically insulate the speaker from the enclosure. Large openings are provided in the enclosure to permit air adjacent the opening to be excited by the speaker. Thus the conventional system of enclosure and speaker is highly directional in that only air in front of the enclosure opening is excited by the speaker.

Another approach is shown in U.S. Pat. No. 3,090,461. In this patent, a speaker is mounted in a vertical defined air column such that sound may emit from openings at the ends of the enclosure as well as through openings cut in the face of the enclosure. Except for the fact that this prior art enclosure utilizes open column of air, it is otherwise in many ways similar to the enclosure employed with string instruments. Again the enclosure is rigid and defines a volume of air which is excited. The resulting sound is directional as a function of the openings.

U.S. Pat. No. 3,486,578 discloses a somewhat similar arrangement wherein again openings are defined in at least one end of an enclosure as well as a elongated openings in the face of the enclosure.

Another interesting variation is discussed in U.S. Pat. No. 3,247,925. This disclosure, which relates to low frequency loud speaker systems, uses a signal stiff panel having, in one form, a honeycomb or foam interior sandwiched between steel sheets, to project sound when driven by another panel connected to a voice coil. The system, however, is rather specific as to frequency ranges, is limited as to direction, and requires rather critical relationships between the various panels.

SUMMARY OF THE INVENTION

The present invention, which provides a heretofore unavailable improvement over previous sound reproduction devices, comprises a device for reproducing sound from electrical signals by driving the entire enclosure as a source of movement to excite the air and produce sound. The device includes a substantially closed — except for vent holes — enclosure, of expanded polymeric material. A speaker system mounted within the enclosure excites the enclosure walls to radiate sound in an essentially omnidirectional manner. Since the enclosures is preferably made of a relatively inexpensive, easily molded material, the sound reproduction device of the instant invention can be easily manufactured at low cost. However, despite these cost and manufacturing advantages, the sound reproduction quality is excellent. The system requires only a minor venting to permit the walls of the enclosure to move.

Thus the system can be substantially sealed against weather and the elements.

Accordingly, it is an object of the present invention to provide a new and improved device for reproducing sound of a particularly pleasing quality and of an omnidirectional nature.

Another object of the present invention is to provide a new and improved device for reproducing sound which may be sealed substantially against the elements.

Yet another object of the present invention is to provide a new and improved device for reproducing sound which may be manufactured at an unusually low cost.

Still another object of the present invention is to provide a device which may be easily manufactured utilizing simple construction procedures.

These and other objects and features of the present invention will become apparent from the following description.

BRIEF DESCRIPTION OF THE DRAWINGS

In the drawings

FIG. 1 is a perspective view of a sound reproduction device according to the instant invention;

FIG. 2 is a perspective view illustrating the bottom of a sound reproduction device according to the instant invention;

FIG. 3 is a front sectional view of the sound reproduction device according to the instant invention;

FIG. 4 is a top sectional view of one portion of the enclosure of the sound reproduction device according to the instant invention; and FIG. 5 is a sectional side view through the enclosure of the sound reproduction according to the instant invention illustrating the movement of the enclosure walls.

DETAIL DESCRIPTION OF THE INVENTION

Turning now to the drawings, the like components are designated by like reference numerals throughout the various figures, a sound reproduction device according to the instant invention is illustrated in FIGS. 1 and 2 and generally designated by the reference numeral 10. Device 10 is formed of an outer portion comprising enclosure halves 11 and 12 secured together as by glueing or ultrasonic sealing along partline 13. As shown in FIG. 1, device 10 is essentially a closed box. Enclosure halves 11 and 12 are formed of a pliant expanded polymeric material, and preferably expanded or foamed polystyrene.

As shown in FIG. 2, device 10 includes bottom supports 15 positioned on the bottom thereof to support device 10. Also, a vent 17 having holes 18 defined therein is disposed in the bottom surface of device 10. Wire 20 passes through an opening in half 12 to supply a signal to a speaker as will be described below in a conventional fashion.

As shown in the sectional view of FIG. 3, a speaker 22 is suspended within enclosure half 12. While speaker 22 may be a conical or dome shaped speaker, it is preferably a wafer type speaker as illustrated. A high frequency diaphragm 24, a middle range diaphragm 25 and a low frequency diaphragm 26 are provided. Sound insulating sheet material 21, preferably of expanded polystyrene, is disposed to secure diaphragms 24, 25 and 26 to mounts 28 on the walls of enclosure half 12. The specifics of the mounting of speaker 22 in enclosure half 12 is further illustrated in FIGS. 4 and 5.

The dynamics of the operation of device 10 will be more readily understood with reference to FIG. 5. As shown, speaker 22 is suspended within the volume defined by enclosure halves 11 and 12. Preferably, the only outlets from the enclosure are the relatively small vent holes 18 positioned at the bottom of device 10 and thus not particularly suited for emitting sound, particularly directional sound. Instead, as illustrated by the broken lines, speaker 22 literally drives the pliable walls of enclosure halves 11 and 12. Thus sound radiates in an omnidirectional manner from the walls of enclosure halves 11 and 12. In operation, the movement of the walls of enclosure halves 11 and 12 are clearly perceivable. In fact, the movement is so pronounced as to require vent holes 18 to avoid dampening of the wall movement through atmospheric pressure. The air within the enclosure halves 11 and 12 serves as a cushioned link between speaker 22 and the walls.

By way of example, a speaker system as above-described was produced having an enclosure with outside dimensions of about 42 centimeters by 42 centimeters by 29 centimeters. Wall thicknesses were about 2 centimeters. Four rows of 1.3 centimeters holes where arranged in the bottom of the enclosure in a five hole, four hole, five hole, four hole staggered pattern. A 40 watt wafer type wide range electrodynamic speaker was attached within the enclosure by glueing the foamed polystyrene sheet in which the speaker was mounted to the enclosure at the corner portions of the enclosure and sheet. When tested, the device was found to have an excellent sound reproduction quality, and a unique nondirectional quality to the sound produced. While not having the distinct multi-directional quality of a multi-speaker, multitrack system, the system, on the other hand, did not appear to be producing sound from a given direction either. This was attributed to the perceptible movement of the enclosure walls which radiated sound in an omnidirectional manner.

Although only preferred embodiments of the present invention have been illustrated and described, it is anticipated that numerous changes and modifications will be apparent to those skilled in the art, and that such changes may be readily made without departing from the scope of the invention as defined by the following claims.

What is claimed is:

1. A sound reproduction device comprising substantially closed enclosure formed of pliable walls of expanded polymeric material having vent holes defined therein and a speaker system means suspended within and fully surrounded by the enclosure with the enclosure shielding the speaker system means from the atmosphere, thereby acoustically driving the pliable enclosure walls which in turn radiate sound in an omnidirectional manner to the atmosphere.

2. A sound reproduction device as set forth in claim 1 in which the enclosure is formed of foamed polystyrene.

3. A sound reproduction system as set forth in claim 1 in which the speaker system is a wafer system and is suspended in the enclosure by a sheet of expanded polymeric material surrounding the speakers and attached to the enclosure walls.

4. A sound reproduction device as set forth in claim 3 in which the speaker system comprises at least three concentric diaphragms.

5. A sound reproduction device as set forth in claim 1 in which supports are provided on one portion of the enclosure and the vent holes are positioned in the same portion of the enclosure, whereby the sound emitting from the holes will be directed downward when the enclosure is resting on the supports.

6. A sound reproduction device as set forth in claim 1 in which the enclosure is formed of two joined unitary sections and is in the shape of a hollow box.

7. A sound reproduction device as set forth in claim 1 in which the enclosure wall thickness is about 1 centimeter.

* * * * *